US005551168A

United States Patent [19]

Van Fossen

[11] Patent Number: 5,551,168

[45] Date of Patent: Sep. 3, 1996

[54] CONTINUOUS-FLOW GRAIN STEEPING AND COOLING SYSTEM

[75] Inventor: Larry Van Fossen, Ames, Iowa

[73] Assignee: Iowa State University Research Foundation, Inc., Ames, Iowa

[21] Appl. No.: 269,748

[22] Filed: Jul. 1, 1994

[51] Int. Cl.[6] ..... F26B 3/00; F26B 19/00

[52] U.S. Cl. ..... 34/491; 34/492; 34/497; 34/429; 34/554; 34/168

[58] Field of Search ..... 34/391, 395, 429, 34/554, 560, 210, 218, 170, 171, 491, 492, 497, 168

[56] References Cited

U.S. PATENT DOCUMENTS

| | | | |
|---|---|---|---|
| 2,858,620 | 11/1958 | Naylor | 34/575 |
| 3,701,203 | 10/1972 | Anderson | 34/170 X |
| 4,035,928 | 7/1977 | Sietmann et al. | 34/560 X |
| 4,125,945 | 11/1978 | Westelaken | 34/171 X |
| 4,126,946 | 11/1978 | Buffington et al. | 34/171 X |
| 4,250,632 | 2/1981 | Botkins et al. . | |
| 4,253,244 | 3/1981 | Kranzler | 34/554 |
| 4,423,557 | 1/1984 | Westelaken . | |
| 4,750,273 | 6/1988 | Parkes et al. | 34/560 X |
| 5,111,596 | 5/1992 | Laurenty . | |
| 5,189,812 | 3/1993 | Ediger . | |

*Primary Examiner*—Hoang Nguyen
*Attorney, Agent, or Firm*—Henderson & Sturm

[57] ABSTRACT

A continuous-flow, slow grain cooling process including the charging of hot, partially dried grain from a heated-air grain dryer into the top of a grain container in an even layer. The downward flow of grain through the grain container is regulated at a rate that allows the grain to remain in a top steeping zone for from four to twelve hours. After the initially charged grain is held at the steeping temperature for a predetermined steeping time, a controlled upward flow of ambient air is provided to cool the grain in a bottom cooling zone. The air flow is provided at a rate that allows grain to remain in the cooling zone until it is cooled close to the ambient air temperature, but the upward flow is controlled such that it will not cool any grain until it has been properly steeped. Cooled dry grain from a layer near the bottom is then discharged from the bottom of the grain container.

7 Claims, 1 Drawing Sheet

CONTINUOUS-FLOW GRAIN STEEPING AND COOLING SYSTEM

TECHNICAL FIELD

This invention relates to a method of conditioning grain, and more particularly to a process for slowly cooling grain partially dried in a heated-air grain dryer.

BACKGROUND ART

Slow grain cooling is a proven, widely adopted and effective technique to cool grain that has been dried in a heated-air grain dryer. Steeping (short-term storage without aeration) and slowly cooling hot, dried grain will efficiently remove an additional one to four points of moisture. There are three recognized main advantages of slowly cooling grain that has been dried in a heated-air dryer: increased drying capacity, reduced operating costs for drying, and improved grain quality.

Specific known processes utilizing slow grain cooling include in-bin cooling, combination high-temperature/low temperature drying and dryeration. Of these processes, dryeration has the greatest potential for rapidly and efficiently reducing moisture content in grain.

In the dryeration process, hot, dried grain is discharged from a heated-air dryer into a grain bin, tank or other grain container where two separate grain conditioning sub-processes occur. The hot grain is first stored without aeration in a container at its removal temperature from the dryer for a predetermined period of time to permit the grain to steep. The removal temperature is the temperature the grain is discharged from the heated air grain dryer, typically 140° F. to 160° F. During this time, usually from four to twelve hours, temperature and moisture tend to become uniform within each kernel. Then the steeped grain is cooled by moving ambient air through it. This dryeration process (steeping and then cooling by aeration) has been commonly found to remove up to four additional points of moisture from the grain after the grain leaves the heated air grain dryer, in addition to the points of moisture removed in the dryer.

The amount of moisture removed in the grain steeping and cooling process is dependent upon the difference of the grain temperature entering and the grain temperature leaving the process and the time the grain is steeped. Although not well verified by research, considerable experience indicates adequately steeped grain will lose 0.20 to 0.25 percentage points of moisture for each 10° F. temperature reduction. The temperature at which the grain leaves the dryer and enters the steeping process is dependent upon the drying air temperature and the efficiency of the heated air grain dryer. Common grain temperatures of grain leaving a dryer operating between 180° F. and 200° F. is 140° F. to 160° F., but both higher and lower dryer operating temperatures and therefore grain temperatures also do occur. The grain temperature will remain at this temperature during steeping and until the grain enters the cooling process, when it is cooled by aeration with ambient air. The temperature of the grain leaving the cooling process is a few degrees below the ambient air temperature. Although an ambient temperature range of 50° F. to 60° F. is common during the fall, both higher and lower temperatures are frequently encountered. Following are two examples of approximate low and high expected moisture reductions during the grain steeping and cooling process:

low, [(100° F.−70° F.)+10° F.]×0.20 points/10° F.=0.60 points high, [200° F.−20° F.)+10° F.]×0.25 points/10° F.=4.50 points One problem with the dryeration process as currently employed is that it is normally practiced as a batch process requiring two grain bins or tanks. Thus, a substantial capital investment is required.

Those concerned with these and other problems recognize the need for an improved slow grain steeping and cooling process.

DISCLOSURE OF THE INVENTION

The present invention provides a continuous-flow, slow grain steeping and cooling process. The process includes the charging of hot, partially dried grain from a heated-air grain dryer into the top of a grain container in a layer of approximately uniform thickness. The downward flow of grain through the grain container is regulated at a rate that allows the grain to remain in a top steeping zone for a predetermined period of time, typically from four to twelve hours. After the initially charged grain is held at the steeping temperature for a predetermined steeping time, a continuous upward flow of ambient air is provided to cool the grain in a bottom cooling zone. The air flow is provided at a rate that allows grain to remain in the cooling zone for a predetermined cooling time depending on the airflow rate in cfm/bu (cubic feet of air per minute per bushel). Cooled dry grain from a layer near the bottom is then discharged from the bottom of the grain container.

An object of the present invention is the provision of an improved slow grain steeping and cooling process.

Another object is to provide a continuous-flow slow grain cooling process that may be practiced in a single grain container.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
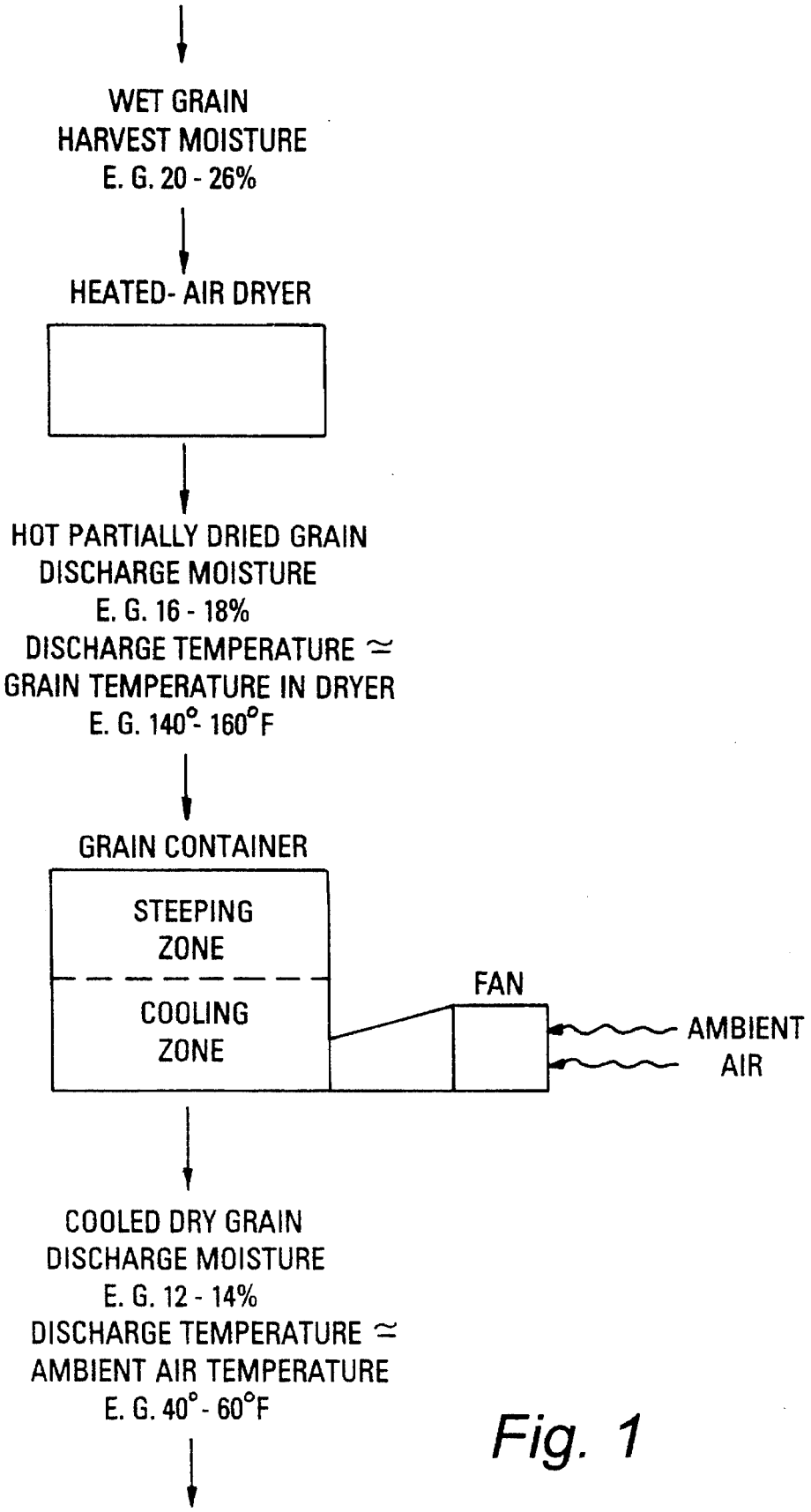
FIG. 1 is a schematic drawing illustrating the flow of grain conditioned by the process of the present invention.

Referring now to the drawings, FIG. 1 illustrates the flow of the grain from harvest as wet grain, through heated-air grain drying, through the continuous-flow grain container, to longer term storage or transported as cool dried grain.

Continuous-flow grain steeping and cooling systems utilize existing or modified equipment commonly used for continuous-flow in-bin drying or newly developed equipment on an existing grain bin, grain tank, self-contained column grain dryer, silo, remodeled or converted corn crib, grain wagon, etc. adapted to incorporate continuous grain flow capability. In the process of the present invention, grain flows into the container at or near the top and is discharged at or near the bottom.

The process is a continuous process that combines grain steeping and grain cooling. The grain container is equipped with continuous-flow grain handling equipment and airflow equipment. Appropriate controls regulate both the flow of grain through the grain container after a predetermined and adequate steeping time and also the discharge of cooled grain from the grain container.

In operation, newly harvested wet grain commonly having a moisture content of approximately 20–26% is transferred from the harvesting equipment to a heated-air grain dryer. The heated-air dryer commonly reduces the grain moisture content to a level of about 16–18% and the partially dried grain is discharged from the dryer without being cooled, e.g. generally, at a temperature of about 140°–160° F. This hot, partially dried grain is then charged into the grain container through an opening at or near the top.

During the start-up phase, hot partially dried grain is laid into the grain container in a layer of approximately uniform thickness by use of a conventional grain spreader or other suitable devices. When the first grain charged into the grain container has achieved a predetermined residence time, typically from four to twelve hours, which can be controlled manually or with an appropriate timing device, a continuous flow of ambient air is directed upwardly through the grain to begin the cooling process. A cooling front travels upwardly through the grain mass while hot, partially dried grain is added to increase the depth of the grain mass. The grain mass is divided into an upper steeping zone and a lower cooling zone as the grain container is filled to a predetermined capacity to complete the start-up phase.

After the initial start up, hot partially dried grain is charged into the top of the grain container in a layer of approximately uniform thickness. The continuous downward flow of grain is regulated at a rate that allows the grain to remain in the steeping zone for a predetermined period of time typically from four to twelve hours. The upward flow of ambient air through the grain mass is provided at a rate that allows the grain to remain in the cooling zone for a predetermined cooling time as determined by the fan airflow rate in cfm/bu. The upward flow of ambient air is interrupted so that the cooling zone does not enter the grain in the steeping zone before that grain has been adequately steeped. Cooled dry grain having a temperature approximately equal to ambient air and a moisture content of about 12–14% is discharged from an approximately uniform thickness layer of grain at the bottom of the container by a bottom mounted sweep auger or augers or other suitable equipment.

The moisture content of the dried grain can be monitored with appropriate grain moisture testing equipment. This equipment and the electrical wiring circuits within the equipment can be designed to select one of two discharge conveyors. One discharge conveyor would move grain that has been adequately dried to storage or to be transported as dried grain. The other discharge conveyor would move grain that is not adequately dried to the wet grain holding bin or tank or to the dryer.

One variation of the present invention is the utilization of the continuous-flow principle to remove hot adequately steeped grain from the grain conditioning container prior to cooling. The hot, steeped grain can be cooled in a storage container, such as a grain bin, equipped with a properly sized fan and air distribution system, such as a perforated floor or duct system. This cooling process will remove approximately the same amount of moisture as the above preceding process. One caution with cooling hot, steeped grain in a storage bin is the possibility of excessive water condensation on the sidewalls, that can run down into the grain and cause serious grain deterioration and storage problems.

Thus, it can be seen that at least all of the stated objectives have been achieved.

Obviously, many modifications and variations of the present invention are possible in light of the above teachings. It is therefore to be understood that, within the scope of the appended claims, the invention may be practiced otherwise than as specifically described.

I claim:

1. A continuous-flow grain conditioning process for a grain container having a top and a bottom, the process comprising the steps of:

heating harvested grain in a grain dryer to produce hot, partially dried grain;

charging the hot, partially dried grain into the top of the grain container in an approximately level and uniformly thick layer; and regulating a downward flow of the grain through the grain container at a rate that allows the grain to remain in a steeping zone for a predetermined steeping time, whereby grain temperature and moisture tend to become uniform within each kernel of the grain.

2. The process of claim 1 further including the steps of:

providing an upward flow of ambient air through the grain container;

controlling the upward flow of ambient air through the grain container at a rate that allows the grain to remain in the steeping zone until grain moisture and temperature tend to become uniform within each kernel Of the grain and also to remain in a bottom cooling zone until the grain is cooled to a temperature close to the ambient air temperature, whereby the combination of steeping and cooling the grain will cause about four additional points of moisture to be removed from the grain;

wherein the ambient air first passes through the grain in the cooling zone and is heated by the grain to the grain temperature at the top of the cooling zone, which is also the bottom of the steeping zone, and then passes through the grain in the steeping zone: and continuously discharging cooled dry grain from an even layer of grain near the bottom of the grain container.

3. The process of claim 1 wherein the hot partially dried grain has a temperature of about 140°–160° F. and a moisture content of about 16–18 percent.

4. The process of claim 1 wherein the predetermined steeping time is from about four hours to about twelve hours.

5. The process of claim 1 wherein grain is cooled to about the ambient air temperature.

6. The process of claim 1 wherein the cooled dry grain has temperature of about the ambient air temperature and a moisture content of about 12–14 percent.

7. The process of claim 2 wherein the cooled dry grain is monitored and conveyed to dry grain storage or transported as dried grain if it is adequately dried or conveyed to a wet grain bin or tank if it is not adequately dried.

* * * * *

UNITED STATES PATENT AND TRADEMARK OFFICE

CERTIFICATE OF CORRECTION

PATENT NO. : 5,551,168

DATED : September 3, 1996

INVENTOR(S) : Larry Van Fossen

It is certified that error appears in the above-indentified patent and that said Letters Patent is hereby corrected as shown below:

Column 2, line 1, should read-- low, [(100° F - 70° F) ÷ 10° F] x 0.20 points/10° F = 0.60 points --.

Column 2, line 2, should read-- high, [200° F - 20° F) ÷ 10° F] x 0.25 points/10° F = 4.50 points --.

Column 4, line 31, claim 2, delete "Of" and insert --of--.

Signed and Sealed this

Eighth Day of April, 1997

*Attest:*

BRUCE LEHMAN

*Attesting Officer*

*Commissioner of Patents and Trademarks*